US005316599A

United States Patent [19]

Ebato et al.

[11] Patent Number: 5,316,599

[45] Date of Patent: May 31, 1994

[54] METHOD OF PRODUCING NI-TI INTERMETALLIC COMPOUNDS

[75] Inventors: Kazuo Ebato; Masaomi Tsuda; Tsutomu Oomori, all of Kanagawa, Japan

[73] Assignee: Nippon Yakin Kogyo Co., Ltd., Tokyo, Japan

[21] Appl. No.: 912,120

[22] Filed: Jul. 9, 1992

Related U.S. Application Data

[63] Continuation-in-part of Ser. No. 610,435, Nov. 7, 1990, abandoned.

[30] Foreign Application Priority Data

Nov. 20, 1989 [JP] Japan ..... 1-299673

[51] Int. Cl.[5] ..... C22C 1/00

[52] U.S. Cl. ..... 148/512; 148/518; 228/194; 228/195

[58] Field of Search ..... 148/512, 518; 228/120, 228/177, 194, 195

[56] References Cited

U.S. PATENT DOCUMENTS

| | | | |
|---|---|---|---|
| 3,708,866 | 1/1973 | Wells | 228/194 |
| 3,769,101 | 10/1973 | Woodward | 148/127 |
| 3,782,926 | 1/1974 | Kirkpatrick | 75/129 |
| 3,981,429 | 9/1976 | Parker | 228/194 |
| 4,029,479 | 6/1977 | Parker | 428/660 |
| 4,710,235 | 12/1987 | Scruggs | 148/127 |
| 4,830,262 | 5/1989 | Ishibe | 148/11.5 Q |

FOREIGN PATENT DOCUMENTS

| | | |
|---|---|---|
| 0070177 | 1/1983 | European Pat. Off. . |
| 1430587 | 3/1976 | United Kingdom . |

*Primary Examiner*—R. Dean
*Assistant Examiner*—Sikyin Ip
*Attorney, Agent, or Firm*—Dvorak and Traub

[57] ABSTRACT

Ni-Ti intermetallic compounds are produced by subjecting a laminate of Ni foils and Ti foils to a rolling for thickness adjustment and then to a diffusion heat treatment at multistages within a particular temperature range for a particular time.

1 Claim, 3 Drawing Sheets

METHOD OF PRODUCING NI-TI INTERMETALLIC COMPOUNDS

This application is a continuation-in-part of the co-pending U.S. application Ser. No. 07/610,435 filed Nov. 7, 1990, now abandoned.

BACKGROUND OF THE INVENTION

1. Field of the Invention

This invention relates to a method of directly producing Ni-Ti intermetallic compounds from a lamination of Ni foils and Ti foils by using reactive diffusion.

2. Related Art Statement

Since Ni-Ti series alloys exhibit various performances in accordance with their chemical compositions, they are advanced to be put into practical use as a material for wide applications.

Heretofore, sheet or wire of Ni-Ti series alloy has been produced through steps of melting→hot rolling→cold rolling→intermediate annealing→cold rolling→ . . . final product likewise usual metallic materials.

However, the production by the above method is very difficult owing to the inherent properties of the Ni-Ti series alloy as mentioned below. For this end, a powder sintering method has been developed instead of the above method. According to the later method, Ni powder and Ti powder are mixed at a ratio corresponding to the final composition ratio and then the mixed powder is shaped into an objective final form or a form similar thereto by a shaping technique such as HIP, CIP, cold powder rolling or the like, which is subjected to a high temperature sintering to obtain a single phase Ni-Ti series alloy through reactive diffusion of Ni and Ti. In this method, the yields at the composition adjustment and the intermediate step are considerably improved as compared with the aforementioned method of from melting to cold working.

The above two methods are a general method used for the production of Ni-Ti series alloy at the present. As another method solving the problems of the above methods, for example, Japanese Patent laid open No. 59-116340 proposes a method wherein Ni and Ti are closely adhered to each other through a film forming method such as pressing, plating, vapor deposition or the like and heated and then reaction-diffused to obtain Ni-Ti phase.

In Japanese Patent laid open No. 62-120467, there has been proposed an improvement of the method described in the aforementioned Japanese Patent laid open No. 59-116340 on the wires of Ni-Ti series alloy, wherein plural composite wires each obtained by covering a surface of Ti core with Ni are bundled together, subjected to working for reducing the size and further to diffusion treatment to produce Ni-Ti phase. This method is sufficiently practical as a method of producing the wire. Furthermore, it is possible to produce a strip of about few mm to few cm by drawing the resulting wire.

As mentioned above, there are proposed various production methods on Ni-Ti series alloys, which have many problems to be solved as mentioned below. A main cause is a point that the atomic ratio of Ni to Ti in the Ni-Ti series alloy exhibiting useful properties is restricted to about 1:1 and the cold workability is very poor as compared with the usual metallic materials.

For example, in the production steps consisting of melting→hot rolling→cold rolling→intermediate annealing→cold rolling . . . final product generally used for obtaining plate-like Ni-Ti series alloy, the combination of cold rolling and intermediate annealing steps should be repeated to a considerable extent for working to a given thickness. Such a repetition of continuous working—softening annealing causes occurrence of edge tear in the rolling, decrease of yield due to oxidation and pickling loss or the like in the annealing pickling, degradation of properties due to the oxidation in the annealing and the like, so that the productivity of Ni-Ti is poor and the cost is too high. Particularly, the production of sheet product through cold working is industrially impossible on a composition of Ni-Ti series alloy containing not less than 50 at % of Ni required for development of super elasticity at low temperature. Since such Ni-Ti alloys are difficult in the working, the wires being relatively easy in the working have mainly been produced in great amount, and the production quantity of sheet product is very small.

As a large factor obstructing the productivity to raise the cost, there is mentioned the difficulty of smelting into adequate composition. For example, in the shape-storing material, it is most important to control the actuating temperature to a given value, but in case of Ni-Ti alloy, the actuating temperature is varied to 10° C. even by the change of Ni concentration of 0.1%. Therefore, the accurate composition adjustment is necessary, but since Ti has very high activity at high temperature and is lost through oxidation loss, reaction with mold or the like in the melt casting, it is very difficult to adjust the composition to the given value. As a result, special equipment is required for the melting, which obstructs a feature that the alloys having a constant quality are cheaply produced with a good yield.

As a method of avoiding various problems through the above smelting and cold working, powder sintering method has been developed. In this method, however, Ti powder which is hardly produced and is expensive should be used, so that the product cost is too high. Therefore, the powder sintering method provides a somewhat advantage when being applied to the production of parts having a complicated shape or various kinds of parts in a small quantity, but is not suitable for the production of products such as plate and strip which should be stably and cheaply be supplied in a certain large amount. In addition, since the surface of powder used as a starting material for a powder sintered body is oxidized to a certain extent, a significant amount of oxide remains in the inside of the final product, which has a problem in the quality of the product.

Furthermore, Japanese Patent laid open No. 59-116340 proposes a method wherein plate and strip are cheaply produced as compared with the powder sintering method by using the same reactive diffusion principle as in the powder sintering method. In this case, when this method is applied to the actual production of plate and strip, if it is intended to obtain Ni-Ti alloy plate of single phase having a thickness of about 0.1 mm, it is required to conduct a diffusion heat treatment for a long time such as several hundred hours. In case that the thickness of each of Ni and Ti layers is thick, defects such as voids or the like are frequently generated in the inside of the plate during the diffusion heat treatment to injury the soundness of the structure, so that the thickness produceable as a practical material by this method is only about several ten micronmeters at most. Thereofre, the latter method can not be said to be practical as an industrial production method.

Moreover, Japanese Patent laid open No. 64-31938 discloses a method considered as an extension of the above production method. According to this method, the material is not particularly limited to Ni-Ti, but plural layers of foil-like metallic material are laminated and then subjected to a heat treatment to conduct diffusion.

In this method, however, the reactive diffusion is solid-phase diffusion, so that in case of the reactive diffusion between Ni and Ti, particularly solid-phase reactive diffusion of flatly laminated Ni-Ti plate as compared with the case of using powder as a starting material, there are caused peculiar problems as mentioned below, and consequently it is difficult to obtain members having a practically usable quality and also the treating time becomes long. Moreover, these problems have been confirmed from the experimental results of the inventors.

(1) A first point is a time required for the reactive diffusion. Considering the same weight, the interface area proceeding the diffusion (specific surface area: $mm^2/g$) is less as compared with the powder, so that the long time is required for the progress of the diffusion.

(2) A second point lies in that voids are frequently generated by Kirkendall effect as a phenomenon inherent to the interactive diffusion because the absolute number of atoms passing per unit interface area is increased by the same cause as mentioned above. Particularly, in case of interactive diffusion between Ni and Ti, the diffusion rate of Ni atom in Ti is larger by 1000 times or more than the diffusion rate of Ti atom in Ni, so that Ni atom largely tends to reduce in the vicinity of the interface, and consequently the occurrence of Kirkendall voids becomes conspicuous. The occurrence of voids not only injures the structure but also obstructs the subsequent reactive diffusion at the interface to interfer the homogenization of the composition, so that it is required to reduce the occurrence of the voids as far as possible. Moreover, the occurrence of voids is closely related to the heat treating temperature of reactive diffusion. In case of Ni-Ti, the occurrence of voids can be controlled to a certain extent at a relatively low temperature of about 700° C., but the diffusion rate becomes later and the homogenization of the composition takes a long time and it is unpractical. On the other hand, the heat treatment is carried out near to an upper limit temperature for solid reaction of about 900° C. in order to shorten the reaction time, but in this case a large amount of voids is generated.

(3) A third point is a phenomenon resulting from a difference in interactive diffusion rate between Ni and Ti, in which the increase and decrease of volume is caused with the advance of diffusion between Ni and Ti layers and hence stress is produced at the interface to cause the mechanical peeling phenomenon. When this point is further explained in detial, the volume naturally tends to relatively reduce in the Ni layer preferentially discharging atom, and in this case such a tendency of volume reduction is macroscopically developed as a decrease of layer thickness in the thickness direction. On the other hand, in the Ti layer absorbing Ni atom, the layer thickness macroscopically increases and also the layer expands in the plane direction. Therefore, the shearing force acts in the plane direction in the vicinity of the interface between Ni and Ti layers, and consequently the mechanical peeling is caused at the interface.

From the above reasons, it is said that the production method described in Japanese Patent laid open No. 64-31938 is not practically applicable in industrial scale.

Although the production method described in Japanese Patent laid open No. 62-120467 can be said to be sufficiently applicable to the industrial production of wire and strip, the size of the resulting article is naturally critical because the size of original wire and strip is restricted, so that this method articles having various sizes such as thicker and wider products can not be produced.

SUMMARY OF THE INVENTION

The invention is to advantageously solve the above problems and to provide a method of advantageously producing Ni-Ti intermetallic compounds which can cheaply produce thicker or wider articles in industry.

The inventors have made various studies in order to solve the above problems and found that the given object can very effectively be achieved when the form of reactive diffusion is not only solid phase diffusion but also is liquid phase diffusion utilizing liquid phase and further homogenization treatment.

That is, when heat treatment is carried out by selecting a temperature range producing liquid phase in a particular composition range at Ni-Ti binary phase diagram, the liquid phase is partly produced at the interface between Ni and Ti, and consequently not only the reaction is completed in a short time but also materials having less defects can be obtained.

Moreover, a liquid phase sintering method in powdery metallurgy is known as a method for including liquid phase in reaction between solid phases. This method utilizes only a component forming a low melting point binder with a relatively small volume percentage as a liquid phase. On the contrary, the method according to the invention is not a concept of using the binder in the liquid sintering method and has a characteristic that the liquid phase forming interface gradually moves together with the advance of diffusion and finally approximately 100% of the material is rendered into a liquid phase state at least at once in accordance with the heat treating conditions, which is entirely different from the liquid phase sintering method.

In the method of the invention, an alternate laminate of Ni foil and Ti foil is subjected to a clad rolling for joining, a rolling for adjusting thickness, a heat treatment in solid phase diffusion region and further a heat treatment in partial liquid phase diffusion region partially producing liquid phase.

That is, the invention lies in a method of producing Ni-Ti intermetallic compounds by alternately laminating plural Ni foils and Ti foils one upon the other, rolling the resulting laminate to a final product thickness and then subjecting it to a heat treatment to form Ni-Ti intermetallic compound having Ni content of 48–55 atomic %, which comprises the steps of:

(a) subjecting the laminate to a rolling for thickness adjustment in which the laminate is rolled at a draft of not less than 30% to join laminated foils to each other and then rolled to render a thickness of each foil into 3–20 μm;

(b) subjecting the rolled laminate to a preliminary sol id phase diffusion heat treatment at a temperature of 650°–780° C. for 1–10 hours;

(c) subjecting to a solid phase diffusion heat treatment at a temperature of 781°-955° C. for 1-10 hours;

(d) subjecting to a first liquid phase diffusion heat treatment at a temperature of 956°-1110° C. for 10 minutes to 1 hour to render only a portion having a Ti content of more than 50 at %;

(e) subjecting to a second liquid phase diffusion heat treatment at a temperature of 1111°-1240° C. for 1 to 10 minutes to render only a portion having a Ni content of more than 50 at %; and (f) finally subjecting to a soaking heat treatment at 1000°-1100° C. for 1 to 10 hours.

BRIEF DESCRIPTION OF THE DRAWING

The invention will be described with reference to the accompanying drawing, wherein.

DESCRIPTION OF THE PREFERRED EMBODIMENTS

The invention is fundamentally an alternate lamination of Ni and Ti foils and a reaction diffusion subjected to the laminate at a state partially producing liquid phase, which will be described in detail below.

Figure 2A:
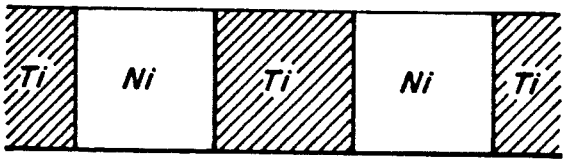
FIG. 2*a* is a schematic view showing outlines of diffusion state in a heat treating step.

In the production of Ni-Ti intermetallic compound, the invention utilizes the diffusion phenomenon between Ni and Ti. Since the invention aims at the production of thin sheets of the Ni-Ti intermetallic compound, Ni foils and Ti foils are first laminated alternately one upon the other and then diffusion is conducted at an interface between Ni foil and Ti foil in the resulting laminate. In order to smoothly conduct the diffusion, it is required to physically and closely join Ni foil and Ti foil to each other at the interface. In order to obtain such a close joining, according to the invention, the laminate comprising Ni foils and Ti foils is subjected to a cold clad rolling at a draft of not less than 30% (see FIG. 2*a*). When the draft is less than 30%, the joining strength between Ni foil and Ti foil is weak and both the foils are easily peeled off from each other after the rolling. The upper limit of the draft is not particularly restricted, but it is 60% because it is difficult to conduct the rolling at a draft of more than 60% from a viewpoint of the ability of the rolling mill. As the joining method, there are considered HIP, hot clad rolling and the like, but a cold clad rolling is most preferable in view of the cost, productivity and the like.

After the joining through the cold clad rolling, the laminate is further rolled to adjust the whole thickness of laminate so that the thickness of the each rolled foil is within a range of 3-20 μm. When the thickness of the rolled foil exceeds 20 μm, even if the subsequent diffusion heat treatment as defined in the invention is carried out, voids and ununiform composition are existent in the final Ni-Ti intermetallic compound and the quality of the product is degraded. While, when it is less than 3 μm, the reduction of time required for the diffusion heat treatment and the soundness of the composition are insufficient and also the increase of the cost and the decrease of the productivity are undesirably produced. That is, according to the invention, Ni and Ti foils each having a thickness of several hundreds μm to several mm are laminated and subjected to the cold clad rolling and further rolled to thin the thickness of each foil to a given range (see FIG. 2*a*).

Then, the thus rolled laminate is subjected to heat treatment consisting of plural stages as mentioned below.

(1) Preliminary solid phase diffusion: When the laminate of Ni-Ti is rapidly heated at a temperature above 781° C., it fuses through self-heat generation based on reaction heat, so that in order to prevent this phenomenon, the laminate is subjected to preliminary solid phase diffusion heat treatment under mild temperature condition to form a reaction layer as a buffer zone for the diffusion.

(2) Solid phase diffusion: In order to prevent the fusion through self-heat generation based on violent reaction at subsequent liquid phase diffusion, the laminate is subjected to solid phase diffusion heat treatment to form a reaction layer as a buffer zone.

(3) First liquid phase diffusion: The unreacted layer of a Ti rich side is diffused at a liquid phase reaction state.

(4) Second liquid phase diffusion: The unreacted layer of a Ni rich side is diffused at a liquid phase reaction state.

(5) Soaking: heat treatment for equalizing ununiform composition in Ni-Ti product.

The heat treatment at each stage will be described in detail below.

Preliminary solid phase diffusion heat treatment

Figure 1:
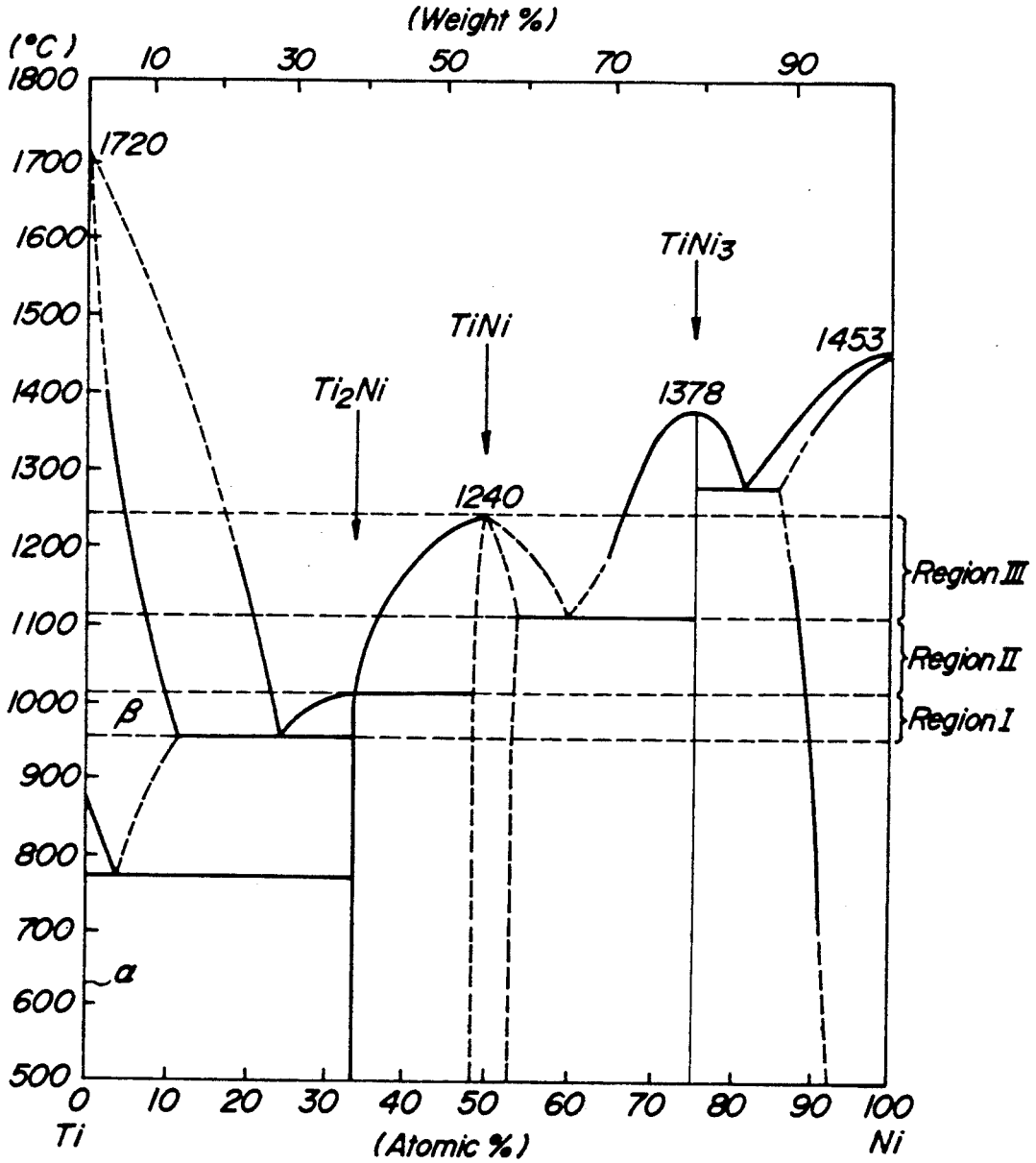
FIG. 1 is an Ni-Ti binary phase diagram.
Figure 2B:
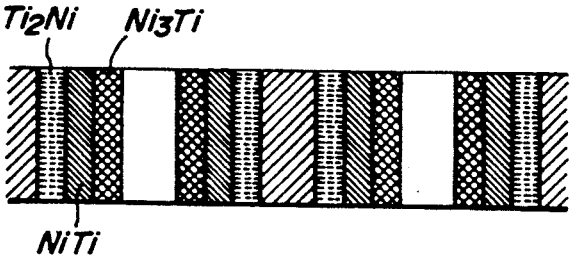
FIG. 2*b* is a further schematic view showing outlines of diffusion state in a heat treating step.

The rolled laminate is subjected to a heat treatment at 650°-780° C. for 1-10 hours. In this case, the upper temperature limit (780° C.) means the temperature that a α-Ti-$Ti_2Ni$ is existent in Ni-Ti binary phase diagram as shown in FIG. 1, while the lower temperature limit (650° C.) means the temperature that interdiffusion rate between Ti and Ni is practically obtained in Ti-Ni binary phase. At such a temperature range, the reaction proceeds through solid phase diffusion to produce compounds of $Ti_2Ni$, NiTi and $Ni_3Ti$ in form of a layer at the Ti-Ni interface (see FIG. 2*b*). Since the reaction of forming NiTi from Ni and Ti is exothermic, when the laminate is rapidly heated, the reaction excessively proceeds and the foils in the laminate fuse over their melting points due to the self-heat generation. In order to prevent the occurrence of this phenomenon, the preliminary solid phase diffusion heat treatment is conducted to form layers of $Ni_3Ti$, TiNi, $Ti_2Ni$ and the like between Ti and Ni as a buffer layer for directly reacting Ti with Ni, whereby the fusion of Ti and Ni foils due to the self-heat generation is prevented.

Solid phase diffusion heat treatment

This treatment is conducted at a temperature of 781°-955° C. for 1-10 hours, in which the upper temperature limit (955° C.) is a temperature causing no liquid phase in the Ni-Ti binary phase diagram of FIG. 1, and the lower temperature limit (781° C.) is a temperature of converting Ti-side portion into β-phase. The reaction at this temperature range is substantially the same as in the preliminary solid phase diffusion heat treatment, but the diffusion rate is very fast. If the solid phase diffusion heat treatment is conducted without the above preliminary solid phase diffusion heat treatment, the laminate fuses through the self-heat generation reaction. Moreover, in order to form a satisfactory amount of reaction layer by the preliminary solid phase diffusion heat treatment, a long time is taken, so that the solid phase diffusion heat treatment is conducted after the preliminary solid phase diffusion heat treatment to shorten the time as a pretreatment for subsequent liquid phase diffusion.

First liquid phase diffusion heat treatment

This treatment is conducted within a temperature range of 956°-1110° C. for 10 minutes to 1 hour. Such a temperature range consists of a region coexisting $\beta$-Ti-Ni solid solution, $Ti_2Ni$ and liquid phase in Ni-Ti binary phase diagram as shown in FIG. 1 (region I) and a region coexisting $\beta$- Ti-Ni solid solution, TiNi and liquid phase but not producing liquid phase at Ni rich side rather than TiNi in the phase diagram of FIG. 1 (region II).

Figure 2C:
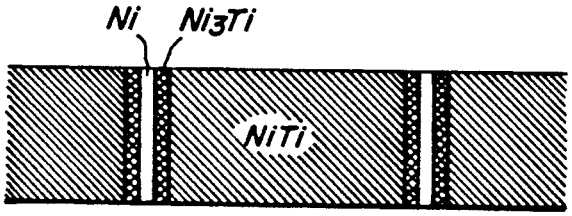
FIG. 2*c* is a further schematic view showing outlines of diffusion state in a heat treating step.

In the region I, the liquid phase is produced in a phase of Ti rich side, and when the reaction is ideally proceeded, 83 vol % of total of the material is finally rendered into the liquid phase and the liquid phase reaction is completed at a time that all of Ti rich side phase is rendered into $Ti_2Ni$ (see FIG. 2*c*).

In fact, Ti somewhat diffuses into Ni side as a solid phase through solid diffusion, so that the liquid phase forming ratio is less than 83 vol %.

Figure 2D:
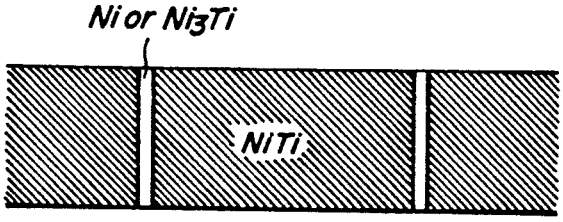
FIG. 2*d* is a further schematic view showing outlines of diffusion state in a heat treating step.

In the region II, liquid phase is formed in the phase of Ti rich side, so that when the reaction is ideally proceeded, about 99 vol % of total of the material finally becomes liquid phase and the liquid phase reaction is completed at a time that all of Ti rich side phase is rendered into a composition of 48 at % Ni - 52 at % Ti (composition on border line of coexisting region of TiNi and TiNi+liquid phase in the phase diagram) (see FIG. 2*d*). The actual liquid phase forming ratio changes in accordance with ratio of Ni to Ti in the laminated state and temperature, while the border between NiTi region and region of NiTi+liquid phase is not completely decided, so that it can not be clearly defined at this time.

At the above temperature range, approximately the whole of the material passes the liquid phase state at once, so that the reaction forming the NiTi single phase is completed for a short time (10 minutes to 1 hour). The rate-determining of the reaction is considered to be a diffusion of Ni into solid solution for producing the melting of $\beta$- Ti-Ni solid solution or a melting reaction between $\beta$-Ti-Ni solid solution and liquid phase interface. In any case, the reaction is not slow, which does not come into question. Moreover, the holding of liquid phase portion in the progress course of the reaction is mainly Ni phase of solid phase state and further $TiNi_3$ produced outside Ni phase through diffusion reaction as well as TiNi phase.

A small amount of unreacted Ni phase and/or $Ni_3Ti$ phase produced by the above solid phase diffusion heat treatment remains in the product after the completion of the first liquid phase diffusion heat treatment. When this temperature is held for a long time after the completion of the first liquid phase diffusion, the reaction shifts into solid phase diffusion to progress the reaction diffusion until the composition of the product as a whole becomes uniform. However, the subsequent heat treatment is conducted in order to achieve homogenization for a shorter time.

Second liquid phase diffusion heat treatment

This treatment is conducted within a temperature range of 1111°-1240° C. for 1-10 minutes. This temperature range is a region coexisting $\beta$-Ti-Ni solid solution, TiNi and liquid phase at Ti rich side rather than NiTi and coexisting $TiNi_3$, TiNi and liquid phase at Ni rich side rather than NiTi in the phase diagram of FIG. 1 (region III).

Figure 2E:
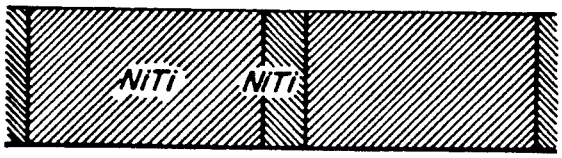
FIG. 2*e* is a further schematic view showing outlines of diffusion state in a heat treating step.

In the region III, the remaining Ni phase held at a solid phase state and a part of $TiNi_3$ and TiNi produced by the diffusion reaction are changed into a liquid phase state to complete the reaction at a state that the whole of the product is TiNi single phase (see FIG. 2*e*).

According to such a two-stage liquid phase diffusion heat treatment, the whole amount of the material passes through liquid phase state at once, in which a part of Ni phase is always existent as a solid phase state at the first half stage, while a part of TiNi phase produced by the reaction is always existent as a solid phase state at the last half stage, so that there is no fear that the material is melted to injury the holding of the shape.

Homogenization heat treatment

The laminate is changed into NiTi single phase by the above diffusion heat treatments as a whole, but there is a composition scattering in accordance with the composition width of NiTi in the phase diagram. For this end, the single phase is subjected to a soaking heat treatment at 1000°-1100° C. for 1-10 hours.

According to the invention, the reason why the composition of Ni in the Ni-Ti intermetallic compound to be produced is limited to 48-55 at % is due to the following fact.

That is, when the lower limit of Ni content is less than 48 at %, compounds having properties useful for shape-storing alloy or super-elastic alloy can not be obtained. While, when it exceeds 55 at %, the material becomes brittle and it can not be put into practical use from a viewpoint of fatigue strength and the like.

In the invention, any conventionally well-known methods such as method of alternately piling foils one upon the other, sputtering method, CVD method, vapor deposition method and the like are suitable as the method of forming Ni-Ti alternate laminated layers. In this case, the thickness of each phase is preferable to become thinner considering the treating time, but there is practically no problem when the thickness is not more than about 20 $\mu$m. In brief, the total thickness of each of Ni and Ti layers should strictly be controlled to the target composition. Moreover, the composition of the intermetallic compound is dependent upon the lamination number.

The following example is given in the illustration of the invention and is not intended as limitation thereof.

EXAMPLE

In the production of Ni-Ti intermetallic compound according to the invention, the starting material was prepared as follows.

In order to obtain an atomic ratio of Ni to Ti of 50.5:49.5, pure Ni foils (thickness 0.40 mm) and pure Ti foils (thickness 0.63 mm) adjusted to a thickness ratio of 38.8:61.2 were alternately laminated one upon the other at the foil number of 7 provided that the thickness of outermost Ni foil was 0.20 mm. The resulting laminate was rolled at a draft of 35% to reduce the thickness from 3.09 mm to 2.0 mm to thereby join the foils to each other and further rolled several times to a final thickness of 100 μm in which an average thickness of each foil was about 17 μm.

Figure 3:
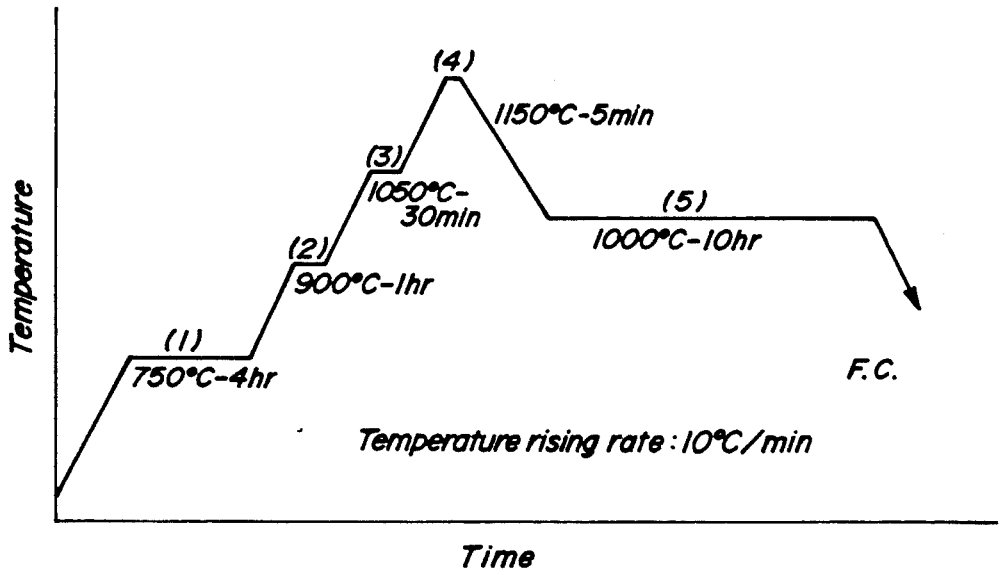
FIG. 3 is a graph showing a pattern of diffusion heat treatment of Ni-Ti.

The thus rolled laminate was subjected to a diffusion heat treatment in accordance with a heat treatment pattern shown in FIG. 3 under conditions of 750° C.—4 hours, 900° C.—1 hour, 1050° C.—30 minutes, 1150° C.—5 minutes and 1000° C.—10 hours under vacuum of not less than $1\times10^{-5}$ Torr, in which each of temperature-rising time and temperature-dropping time was 10° C./min. In this case, the heat treatment was conducted by placing the laminate on a flat plate of zirconia ceramics.

When the thus obtained product was deformed at room temperature and then immersed in warm water of 90° C., it was immediately turned to the original shape. Furthermore, when the section of the product was observed by means of a microscope, the lamination structure existing before the diffusion heat treatment was disappeared to form a complete NiTi single phase state.

Comparative Example

Ni foils and Ti foils each having a thickness of 20 μm were alternately laminated one upon the other to a total thickness of 0.5 mm, which was cold rolled at a reduction of 10% and then subjected to a diffusion annealing at 950° C. for 5 hours.

When the section of the thus obtained specimen was observed by means of a microscope, many layer-like voids were generated, so that it was difficult to manufacture wide and thick products in industry.

As mentioned above, according to the invention, thick and wide Ni-Ti intermetallic compounds, which have never been manufactured by the conventional method in industrial scale, can cheaply be produced in a high quality for a short time.

What is claimed is:

1. A method of producing Ni-Ti intermetallic compounds by alternately laminating plural Ni foils and Ti foils one upon the other, rolling the laminate to a final product thickness and then subjecting it to a heat treatment to form Ni-Ti intermetallic compound having Ni content of 48–55 atomic %, which comprises the steps of:

(a) subjecting the laminate to a rolling for thickness adjustment in which the laminate is rolled at a draft of not less than 30% to join laminated foils to each other and then rolled to render a thickness of each foil into 3–20 μm;

(b) subjecting the rolled laminate to a preliminary solid phase diffusion heat treatment at a temperature of 650°–780° C. for 1–10 hours;

(c) subjecting to a solid phase diffusion heat treatment at a temperature of 781°–955° C. for 1–10 hours;

(d) subjecting to a first liquid phase diffusion heat treatment at a temperature of 956°–1110° C. for 10 minutes to 1 hour to render only a portion having a Ti content of more than 50 at %;

(e) subjecting to a second liquid phase diffusion heat treatment at a temperature of 1111°–1240° C. for 1 to 10 minutes to render only a portion having a Ni content of more than 50 at %; and (f) finally subjecting to a soaking heat treatment at 1000°–1100° C. for 1 to 10 hours.

* * * * *